US007123865B2

(12) United States Patent
Kita

(10) Patent No.: US 7,123,865 B2
(45) Date of Patent: Oct. 17, 2006

(54) TONER CONVEYING DEVICE FOR AN IMAGE FORMING APPARATUS AND TONER REPLENISHING DEVICE INCLUDING THE SAME

(75) Inventor: Emi Kita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 250 days.

(21) Appl. No.: 10/752,561

(22) Filed: Jan. 8, 2004

(65) Prior Publication Data

US 2004/0190944 A1 Sep. 30, 2004

(30) Foreign Application Priority Data

Jan. 21, 2003 (JP) ..... 2003-012154

(51) Int. Cl.
*G03G 15/08* (2006.01)

(52) U.S. Cl. ..... 399/258

(58) Field of Classification Search ..... 399/222, 399/252, 258, 260, 262, 107, 119, 259, 263, 399/253; 430/111.1, 137.14
See application file for complete search history.

(56) References Cited

U.S. PATENT DOCUMENTS

| | | | | |
|---|---|---|---|---|
| 5,953,567 | A * | 9/1999 | Muramatsu et al. | 399/256 |
| 6,336,022 | B1 * | 1/2002 | Ichikawa et al. | 399/254 |
| 6,480,695 | B1 * | 11/2002 | Endo et al. | 399/349 |
| 6,720,123 | B1 * | 4/2004 | Xu et al. | 430/137.14 |
| 2005/0163537 | A1 * | 7/2005 | Muramatsu et al. | 399/258 |

FOREIGN PATENT DOCUMENTS

| | | |
|---|---|---|
| JP | 2001-249525 | 9/2001 |
| JP | 2002-62760 | 2/2002 |

* cited by examiner

*Primary Examiner*—Hoan Tran
(74) *Attorney, Agent, or Firm*—Oblon, Spivak, McClelland, Maier & Neustadt, P.C.

(57) ABSTRACT

A toner conveying device conveys powdery toner with a screw pump including an elastic stator formed with spiral grooves in its inside periphery and a rotor rotatable inside the stator for conveying the toner in the axial direction. The toner includes a polymerized toner having mean circularity of 0.95 to 0.99.

27 Claims, 10 Drawing Sheets

TONER CONVEYING DEVICE FOR AN IMAGE FORMING APPARATUS AND TONER REPLENISHING DEVICE INCLUDING THE SAME

BACKGROUND OF THE INVENTION

1. Field of the Invention

The present invention relates to a printer, copier, facsimile apparatus or similar electrophotographic image forming apparatus and more particularly to a toner conveying device for use in the image forming apparatus and a toner replenishing device including the same.

2. Description of the Background Art

An electrophotographic image forming apparatus includes a developing device for developing a latent image formed on an image carrier with a developer. When a two-component type developer, i.e., a toner and carrier mixture is used as a developer, a toner bottle, toner cartridge, toner tank or similar toner container is positioned in the vicinity of the developing device in order to replenish fresh toner to the developing device, as needed. A full-color image forming apparatus, extensively used today, needs four developing devices and four toner containers respectively storing yellow, magenta, cyan and black toners. In addition, it is necessary with such an image forming apparatus to make the configuration compact without reducing the amount of toner to be stored in each toner container. In this respect, arranging a particular toner container in the vicinity of each developing device not only obstructs the compact configuration of the apparatus, but also noticeably limits design freedom.

In light of the above, Japanese Patent Laid-Open Publication No. 2000-81778, for example, discloses an image forming apparatus in which a suction type of screw pump, generally referred to as a Mono pump, is used to replenish toner from a toner container to a developing device. This configuration allows the toner container to be located at any desired position as a unit independent of the developing device. However, the apparatus taught in the above document has some problems left unsolved, as will be described hereinafter.

When the screw pump replenishes toner to the developing device, frictional resistance acts between toner grains and the outer periphery of a rotor, between the toner grains and the walls of spiral grooves formed in a stator and between the toner grains themselves, obstructing the movement of the toner grains and exerting a torque when the screw pump is driven. It follows that if the shape of the toner grains is amorphous far different from a sphere, then it is likely that the toner grains are caught by the outer periphery of the rotor, the walls of the spiral grooves of the stator and each other, aggravating the drive torque of the screw pump.

Further, because the suction type of screw pump sucks the toner from the toner container by generating vacuum, it sucks small, light toner grains more easily than large, heavy toner grains. Consequently, if the size of the toner grains is distributed over a broad range, then it is likely that small toner grains are replenished before large toner grains with the result that the toner grain size of the developer noticeably varies and brings about various image defects including background contamination.

Technologies relating to the present invention are also disclosed in, e.g., Japanese Patent Laid-Open Publication Nos. 2001-249525 and 2002-62760.

SUMMARY OF THE INVENTION

It is an object of the present invention to provide a toner conveying device capable of reducing the drive torque of a screw pump and insuring high-quality images, a toner replenishing device including the same, and an image forming apparatus using them.

A toner conveying device of the present invention conveys powdery toner with a screw pump including an elastic stator formed with spiral grooves in its inside periphery and a rotor rotatable inside the stator for conveying the toner in the axial direction. The toner comprises a polymerized toner having mean circularity of 0.95 to 0.99.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
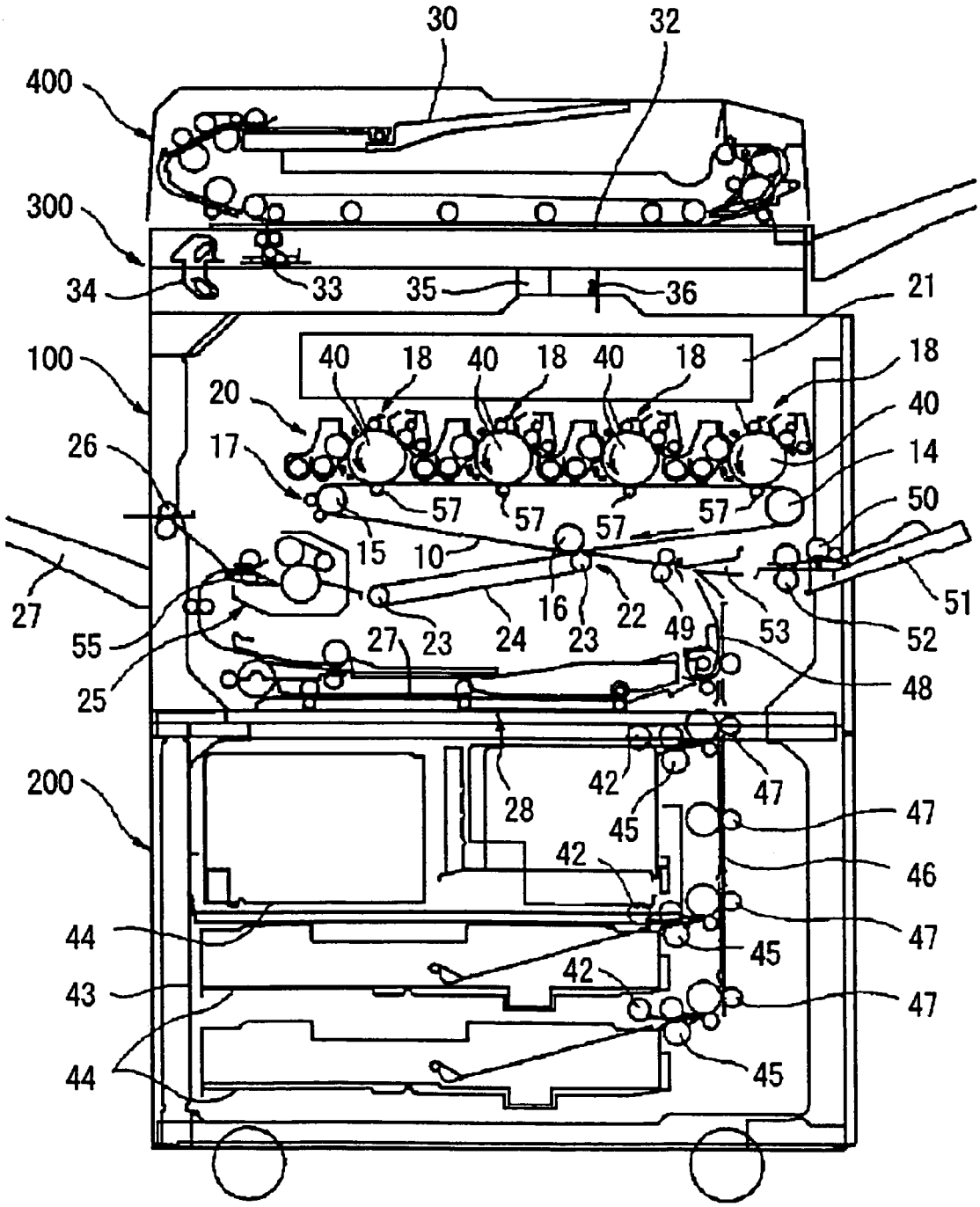
FIG. 1 is a view showing an image forming apparatus embodying the present invention.

Referring to FIG. 1 of the drawings, an image forming apparatus embodying the present invention is shown and implemented as a color copier by way of example. As shown, the color copier includes a copier body 100, a table-like sheet feeder on which the copier body 100 is mounted, a scanner 300 mounted on the copier body 100, and an ADF (Automatic Document Feeder) 400 mounted on the scanner 300.

An intermediate image transfer belt (simply belt hereinafter) 10, comprising an endless flexible belt, is disposed in the copier body 100 and passed over a plurality of rollers 14, 15 and 16. A drive source, not shown, causes one of the rollers 14 through 16 to rotate for thereby causing the belt 10 to turn clockwise, as indicated by an arrow in FIG. 1. The other rollers are caused to rotate by the belt 10. Four image forming units 18, respectively assigned to black, cyan, magenta and yellow, are arranged side by side along the upper run of the belt 10, constituting a tandem image forming section 20 between the rollers 14 and 15.

The four image forming units 18 each include a photoconductive drum or image carrier 40 and a charger, a developing device, a cleaning device and a quenching lamp arranged around the drum 40. An image transferring device 57 faces the drum 40 with the intermediary of the belt 10. The image forming units 18 are identical in configuration with each other except for the color of toner to deal with. An exposing unit 21 is positioned above the image forming units 18 and scans the drum 40 of each image forming unit 18 with a particular laser beam imagewise at a position between the charger and the developing device. While a particular exposing device may be assigned to each image forming unit 18, a single exposing unit shared by all the image forming units 18 is desirable from the cost standpoint.

A secondary image transferring device 22 is positioned at opposite side to the tandem image forming section 20 with respect to the belt 10. The secondary image transferring device 22 includes a belt conveyor 24 passed over a pair of rollers 23 and pressed against the roller 16 via the belt 10. A fixing unit 25 is positioned at the left-hand side of the secondary image transferring device 22, as viewed in FIG. 2, and fixes a toner image transferred to a sheet.

The secondary image transferring device 22 additionally functions to convey the sheet, carrying the toner image thereon, to the fixing unit 25. While the secondary image transferring device 22 may alternatively be implemented as a charger, the charger must be accompanied by an exclusive sheet conveying device.

A sheet turning device 28 is arranged below the secondary image transferring device 22 and fixing unit 25 in parallel to the image forming section 20. In a duplex copy mode, the sheet turning device 28 turns a sheet in order to form toner images on both surfaces of a sheet.

In operation, the operator of the copier sets a desired document on a document tray 30 included in the ADF 400 or opens the ADF 400, sets the document on a glass platen 32 included in the scanner 300 and then closes the ADF 400. The operator then presses a start switch not shown. In response, the scanner 300 is immediately driven when the document is set on the glass platen 32 or driven after the document set on the ADF 400 has been conveyed to the glass platen 32, causing a first and a second carriage 33 and 34 to start running. While a light source, mounted on the first carriage 33, emits light toward the document, the resulting reflection from the document is reflected by the first carriage 33 toward the second carriage 34. The light is then incident to a mirror, which is mounted on the second carriage 34 and reflected to an image sensor 36 via a lens 35.

When the start switch is pressed, the belt 10 is caused to turn while the drums 40 of the image forming units 18 are caused to rotate. In this condition, a black, a yellow, a magenta and a cyan toner image are respectively formed on the four drums 40. The toner images of such different colors are sequentially transferred from the drums 40 to the belt 10 one above the other, completing a color image on the belt 10.

Further, when the start switch is pressed, one of pickup rollers 42, included in the sheet feeder 200, is rotated to pay out a sheet from associated one of sheet cassettes 44 included in a sheet bank 43. At this instant, a reverse roller 45 separates the sheet being so picked up from the other sheets. The sheet is conveyed to a roller pair 47 via a sheet path 46 and then conveyed to a sheet path 48 arranged in the copier body 100 thereby until it abuts against a registration roller pair 49.

On the other hand, when sheets are stacked on a manual sheet feed tray 51, a pickup roller 50 assigned to the tray 51 picks up one sheet while a reverse roller 42 separates the sheet being picked up from the other sheets. The sheet thus paid out is also caused to abut against the registration roller pair 49 via a sheet path 53.

The registration roller pair 49 starts conveying the sheet to a nip between the belt 10 and the secondary image transferring device 22, so that the color image is transferred from the belt 10 to the sheet by the secondary image transferring device 22.

The sheet, carrying the color image thereon, is conveyed to the fixing unit 25 by the secondary image transferring device 22 and has the color image fixed thereon by heat and pressure. The sheet, coming out of the fixing unit 25, is steered by a path selector 55 toward a copy tray 27 via an outlet roller pair 26 or toward the sheet turning device 28. When the sheet is introduced into the sheet turning device 28, it is turned upside down and again conveyed to the image forming section 20. In this case, after another color image has been transferred to the reverse surface of the sheet, the sheet is driven out to the copy tray 27 via the outlet roller pair 26.

After image transfer, a belt cleaning device 17 removes toner left on the belt 10 for thereby preparing it for the next image formation.

Figure 2:
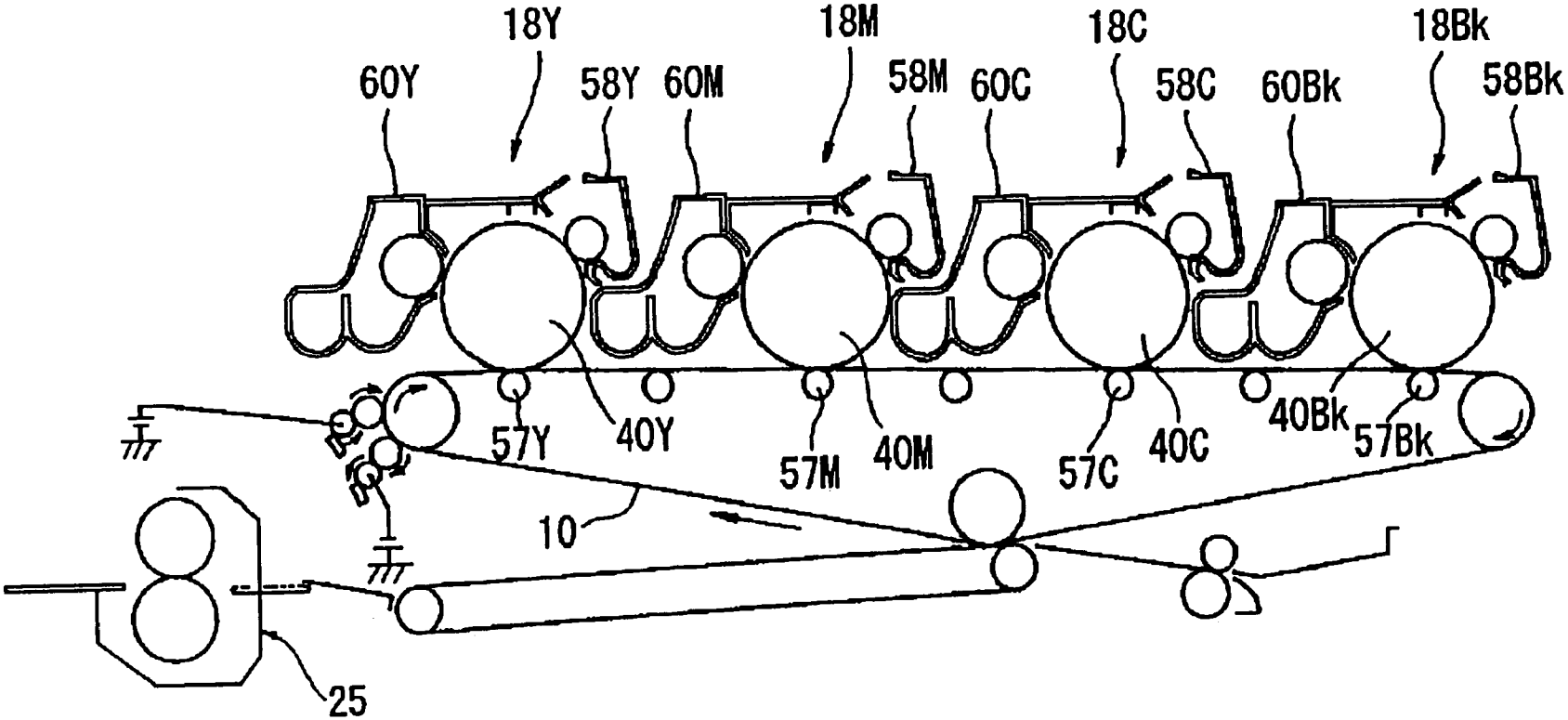
FIG. 2 is a view showing a tandem image forming section included in the illustrative embodiment.
Figure 3:
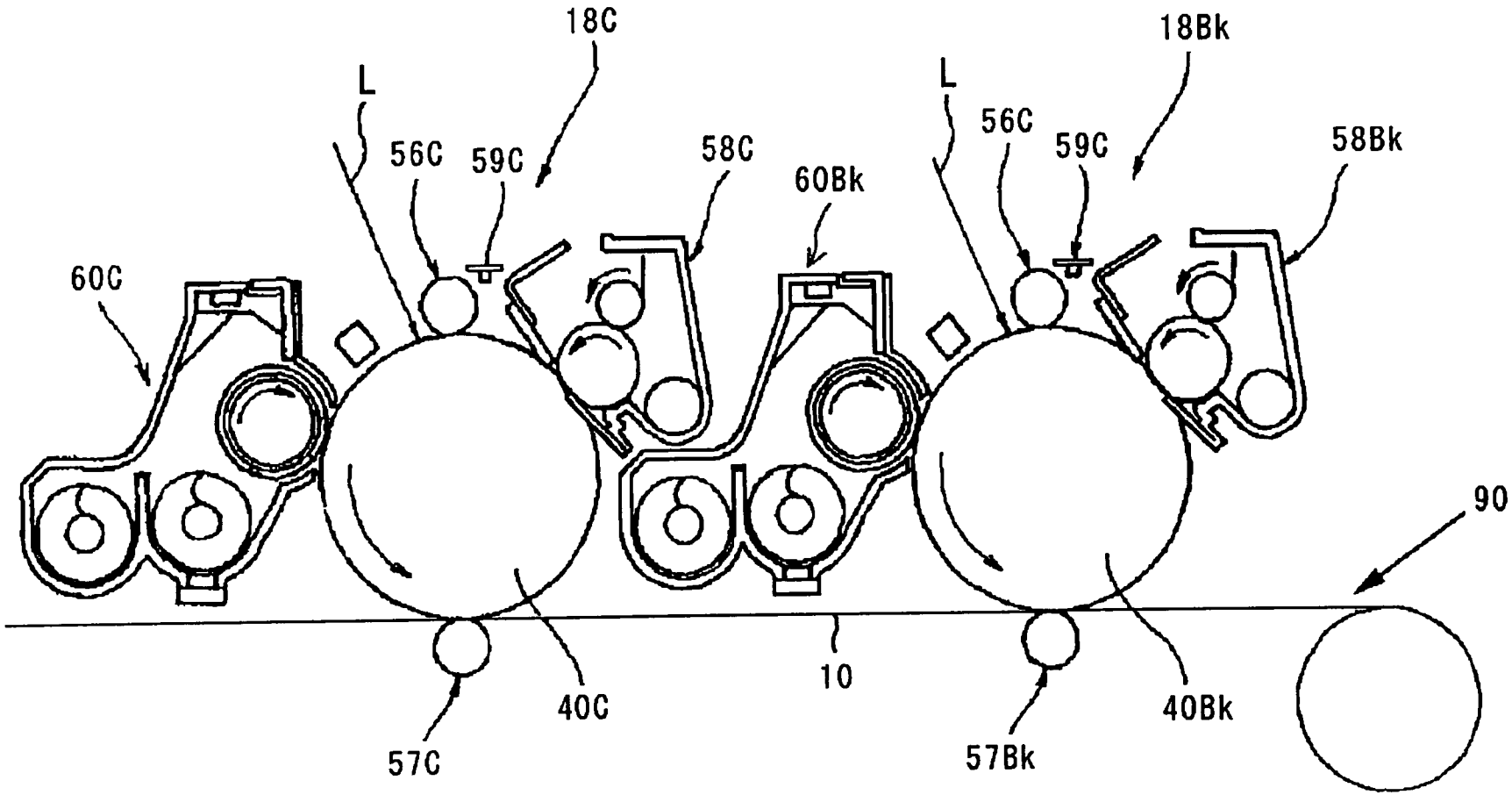
FIG. 3 is a view showing essential part of the tandem image forming section.

FIG. 2 shows essential part of the color copier described above in detail. As shown, image forming units 18Y (yellow), 18M (magenta), 18C (cyan) and 18Bk (black) are sequentially arranged in this order from the upstream side toward the downstream side of the belt 10. As shown in FIG. 3, each image forming unit, labeled 18 hereinafter, includes a charger 56, a developing device 60, a primary image transferring device 57, a cleaning device 58 and a quenching lamp 59 arranged around the drum 40. In FIG. 3, labeled L is a laser beam emitted from the exposing unit 21, FIG. 1, to the drum 40. With this arrangement, it is possible to reduce, in a black mode, the first copy time by a distance between the most upstream drum 40Y and the most downstream drum 40Bk.

Figure 4:
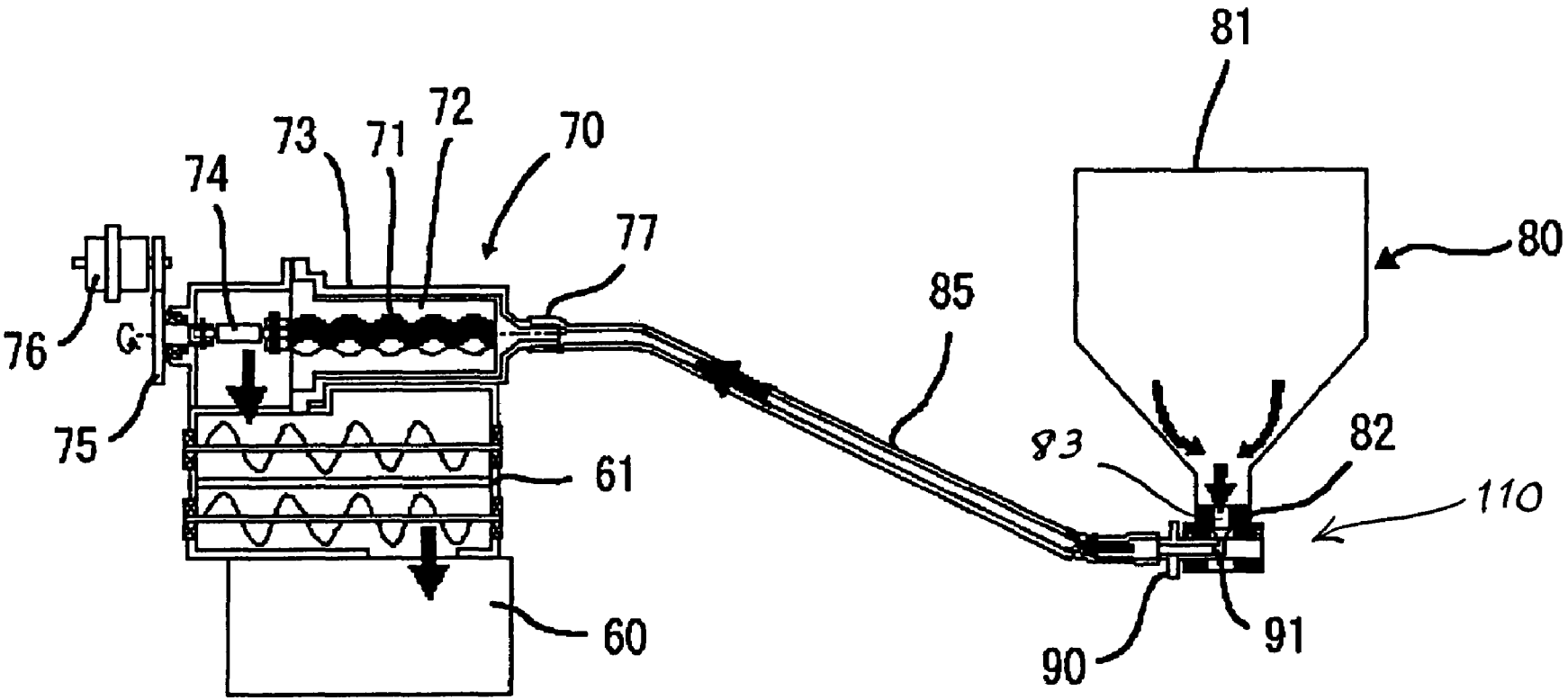
FIG. 4 is a view showing a toner replenishing device also included in the illustrative embodiment.

FIG. 4 shows a toner replenishing device configured to replenish fresh toner to the developing device 60 with a toner conveying device using screw pump means. As shown, a toner container 80, storing fresh toner to be replenished, is set on amount portion 110, which will be described later, included in the copier body 100. The mount portion 110 includes a nozzle 90 that penetrates into the toner container 80 when the toner container 80 is set on the mount portion 110. A passage 91 is formed in the nozzle 90 and fluidly communicated to a tube 85, which is connected to the end of the nozzle 90.

The toner container 80 includes a deformable bag 81 constituted by a single layer or a laminate of 80 μm to 200 μm thick flexible sheets formed of polyester or polyethylene. A mouth member 82 is affixed to the bottom center of the bag 81 and formed with a toner outlet 83, which is communicated to the bag 81 and passage 91 at opposite ends thereof. The bag 81 is tapered toward the toner outlet 83 in order to cause a minimum of toner to remain in the bag 81.

A subhopper or auxiliary toner storing section 61 is formed in the upper portion of the developing device 60 such that the toner delivered from the toner container 80 is introduced into the subhopper 61. A powder pump or screw pump means 70 is positioned above the subhopper 61 for conveying the toner from the toner container 80 to the subhopper 61. The powder pump 70, comprising a uniaxial eccentric screw pump, includes a rotor 71, a stator 72 and a holder 73. The rotor 71 is formed of metal or similar rigid material and configured as an eccentric screw. The stator 72 is formed of rubber or similar elastic material and formed with two spiral grooves. The holder 73 is formed of, e.g., resin and surrounds the rotor 71 and stator 72 while forming a powder passage. The rotor 71 is connected to a drive shaft 74 via a pin joint. A gear 75 is mounted on the drive shaft 74 and connected to a first clutch 76 via an idle gear not shown. The first clutch 76 is selectively coupled or uncoupled for controlling the drive of the powder pump 70. The first clutch 76 and a second clutch 68, which will be described layer, are mounted on a drive shaft 79, see FIG. 5, which is driven by a drive source not shown.

The tube 85 is connected to a suction port 77 formed in the right end of the holder 73, as viewed in FIG. 4. The tube 85 has a diameter of, e.g., 4 mm to 10 mm and should preferably be formed of a flexible material, e.g., polyurethane, nitril, EPDM, silicone or similar rubber highly resistant to toner, so that the tube 85 can be arranged in any desired direction.

Figure 6:
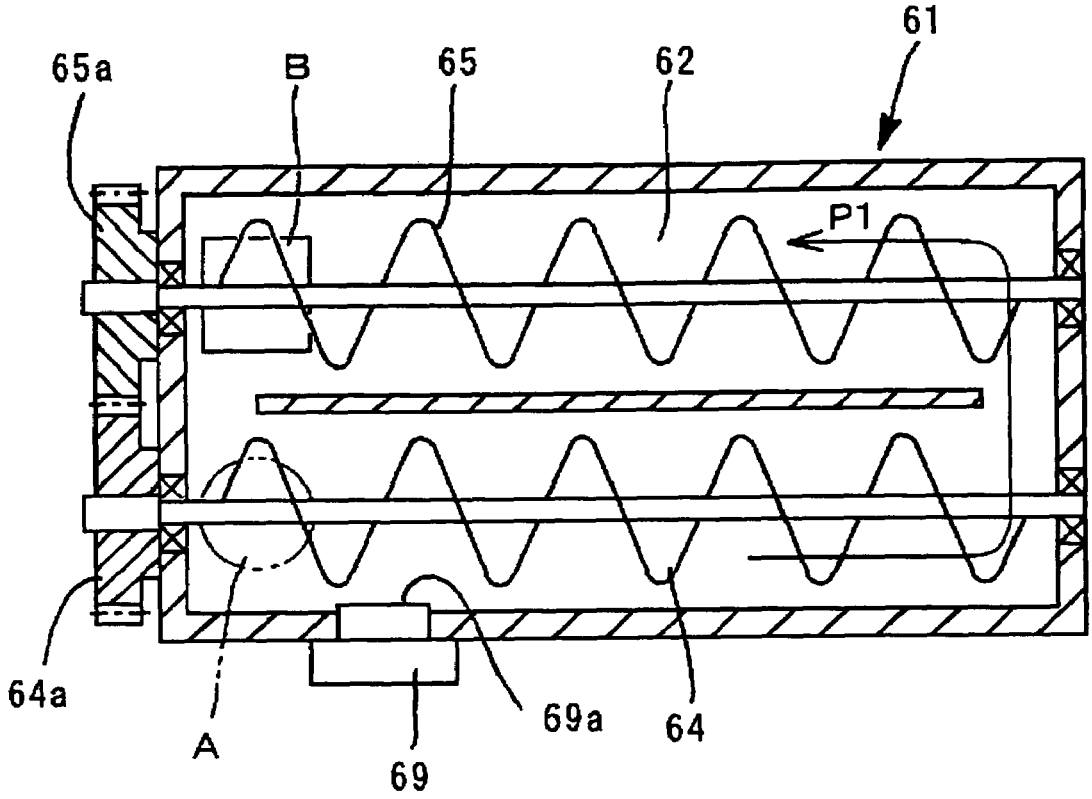
FIG. 6 shows an upper chamber forming part of a subhopper included in the toner replenishing device.
Figure 7:
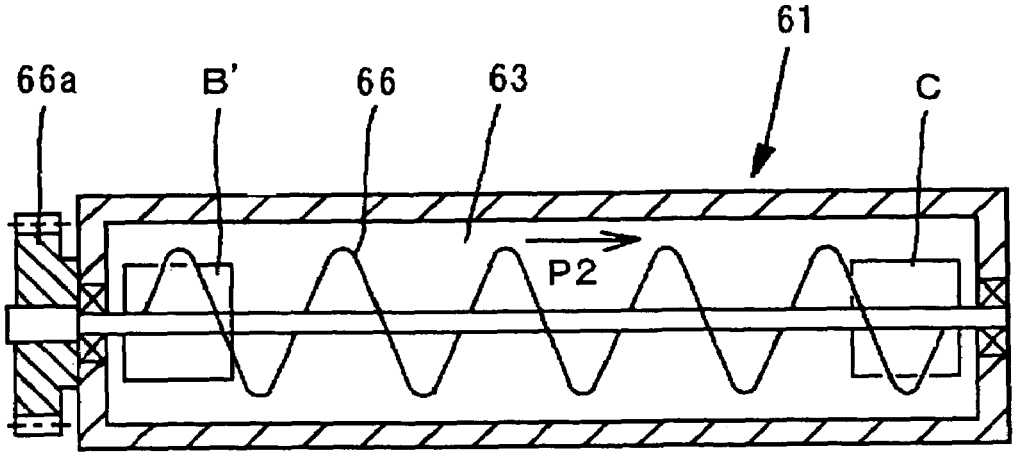
FIG. 7 shows a lower chamber forming the other part of the subhopper.

The subhopper 61 has a cross-section generally resembling an inverted triangle. As shown in FIGS. 6 and 7, the inside of the subhopper 61 is divided into an upper and a lower chamber 62 and 63. A pair of upper screws 64 and 65 are disposed in the upper chamber 62, which has a larger bottom area than the lower chamber 63, and isolated from each other by a partition which is cut away at opposite ends. As shown in FIG. 6, toner replenished by the powder pump 70 is introduced into the upper chamber 62 at a position A and then conveyed by the upper screw 64 and 65 in a direction indicated by an arrow P1. The toner thus conveyed in the direction P1 drops from the upper chamber 62 into the lower chamber 63 via an opening B.

As shown in FIG. 7, a lower screw 66 is disposed in the lower chamber 63. The toner, dropped via the opening 8 mentioned above, is introduced into the lower chamber 63 at a position B', conveyed by the lower screw 66 in a direction indicated by an arrow P2, and then caused to drop into the developing device 60 via an opening C.

Figure 5:
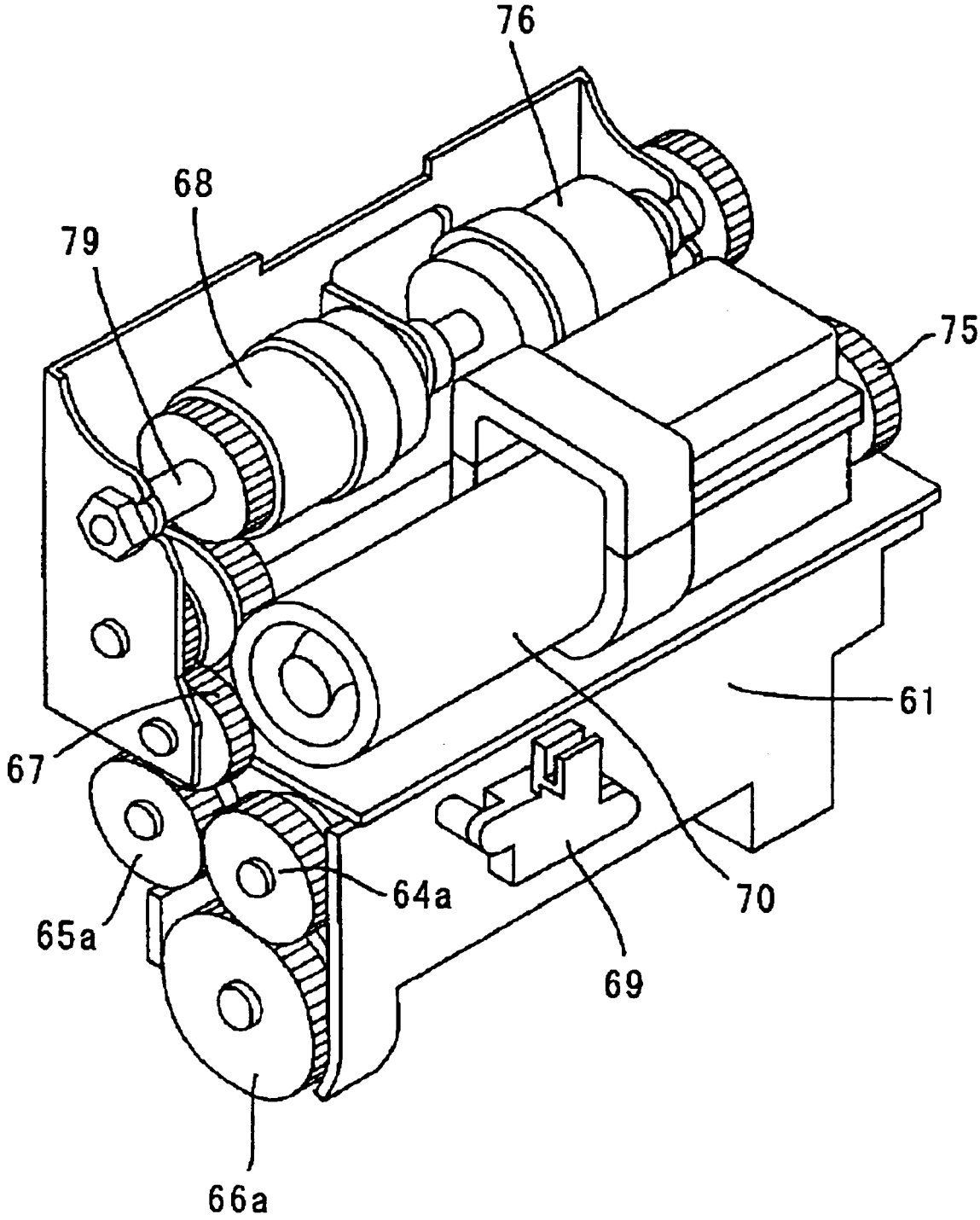
FIG. 5 is an isometric view of the toner replenishing device.

As stated above, the toner delivered from the powder pump 70 is temporarily stored in the subhopper 61 and then conveyed to the developing device 60 by the screws 64, 65 and 66. In this sense, the screws 64 through 66 constitute toner conveying means arranged in the subhopper 61. As shown in FIG. 5, gears 64*a*, 65*a* and 66*a*, respectively mounted on the screws 64, 65 and 66, are connected to the second clutch 68 via an idle gear train 67, so that the screws 64, 65 and 66 are selectively driven via the second clutch 68.

A toner sensor or toner sensing means 69 is mounted on the wall of the subhopper 61 adjoining the position A, FIG. 6, in order to sense a preselected amount of toner. As shown in FIG. 6, the toner sensor, comprising a vibration type of sensor, is positioned such that its sensing surface 69*a* contacts the toner present in the upper chamber 63.

In operation, when a replenish command is output in accordance with the output of, e.g., a toner content sensor not shown, the second clutch 68 is coupled to cause the upper screws 64 and 65 and lower screw 66 to rotate and replenish the toner to the developing device 60. The amount of toner replenished corresponds to the duration of rotation of the screws 64 through 66. On the other hand, when the amount of toner in the subhopper 61 being monitored by the toner sensor 69 decreases below the preselected amount, the powder pump 70 is driven to generate vacuum therein with the result that the toner in the toner container 80 is delivered to the subhopper 61. At this instant, the amount of toner to be fed to the subhopper 61 does not have to be accurately controlled. For this reason, the amount of toner to be conveyed by the powder pump 70 is selected to be larger than the amount of toner to be replenished to the developing device 60 by the screws 64 through 66. The toner container 80, which is flexible, automatically decreases in volume in accordance with the delivery of the toner by the powder pump 70.

When the amount of toner being sensed by the toner sensor 69 remains below the preselected amount even after the powder pump 70 has been operated a plurality of times, it is determined that the toner. container 80 has substantially run out of toner, i.e., a toner near-end condition has been reached. In response, a message, urging the operator to replace the toner container 80, is displayed on a control panel, not shown, byway of example. When the tone container 80 is not replaced, the copier is caused to stop operating after a preselected number of copies have been output.

Figure 8:
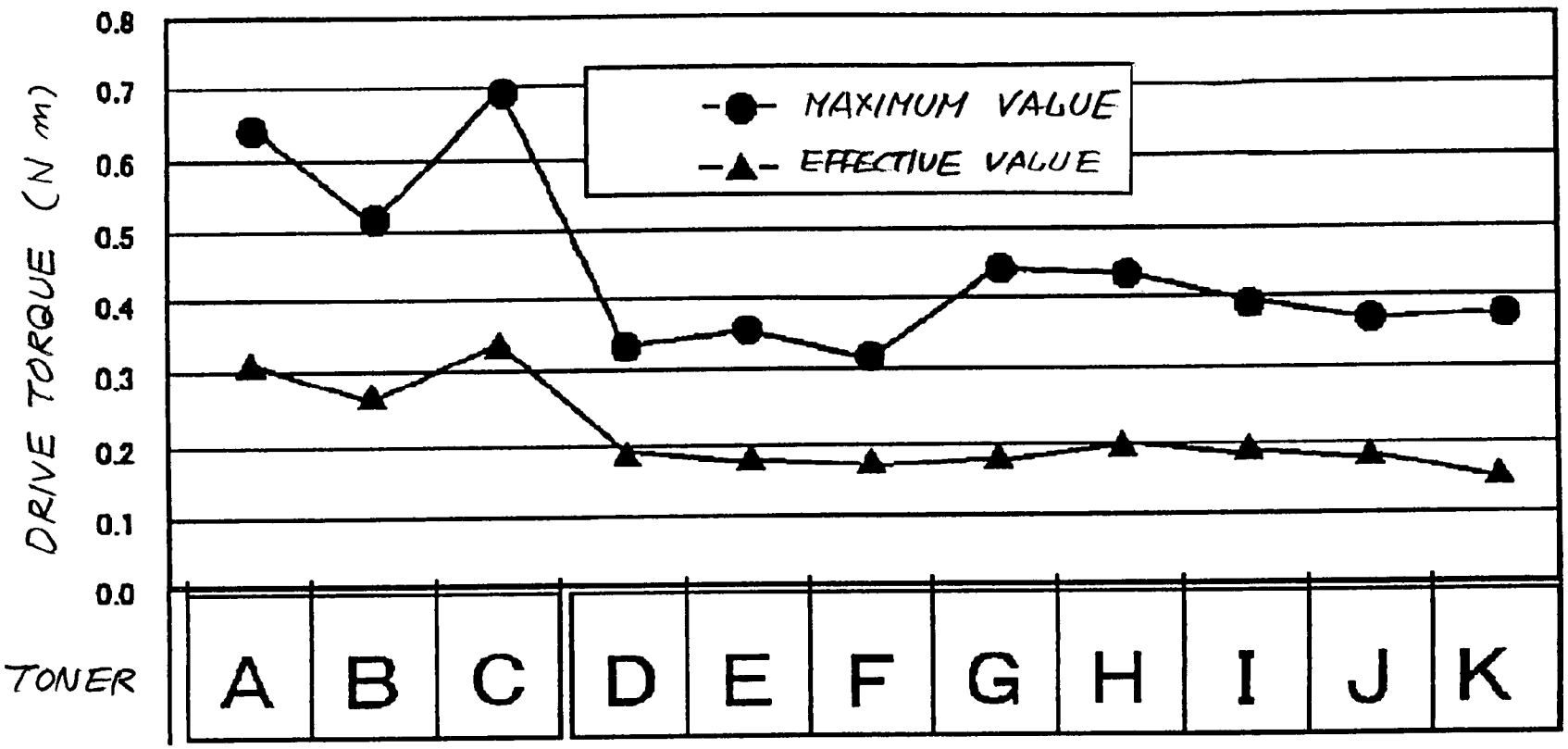
FIG. 8 is a graph showing a relation between the kind of toner and the drive torque determined with the toner replenishing device of FIG. 4.

I found that the drive torque of the powder pump 70 was dependent on the kind of toner used. FIG. 8 shows a relation between the kind of toner and the drive torque of the powder pump 70, as determined by experiments using the toner replenishing device stated above. In FIG. 8, toners A, B and C are pulverized toners while toners D, E, F, G, H, I, J and K are polymerized toners. As FIG. 8 indicates, the maximum drive torque and effective drive torque both are lower when the toners D through K are used than when the toners A through C are used.

The above experiments showed that it was important to provide the toner with a particular shape and a particular shape distribution. To measure the shape of toner, there should preferably be used a method that passes a suspension, containing rains, through a flat, pickup sensing band while optically sensing and analyzing the grains with a CCD (Charge Coupled Device) camera. The toners D through K had mean circularity ranging from 0.95 to 0.99. Mean circularity refers to a value produced by dividing the circumferential length of a circle with the same projection area obtained by the above method by the circumferential length of the actual grain. It was found that even if the toner contained gains with mean circularity ranging from 0.96 to 0.99 and circularity of less than 0.95, the drive torque of the powder pump 70 was successfully reduced if the ratio of such grains was 10% or below. This is presumably because friction between the grains, friction between the grains and the periphery of the rotor and friction between the grains and the walls of the spiral grooves of the stator decrease as the shape of the grains approaches a sphere.

Further, the amount of toner replenishment for a unit time increases with a decrease in the above friction, allowing the size of the powder pump 70 and the duration of drive of the powder pump 70 to be reduced. This successfully saves power and enhances durability of the powder pump 70. In addition, a decrease in the drive torque of the powder pump 70 and an increase in the amount of toner replenishment both serve to reduce stresses to act on the toner grains, thereby insuring images free from various defects, including local omission, ascribable to the deterioration of the toner grains.

Figure 9:
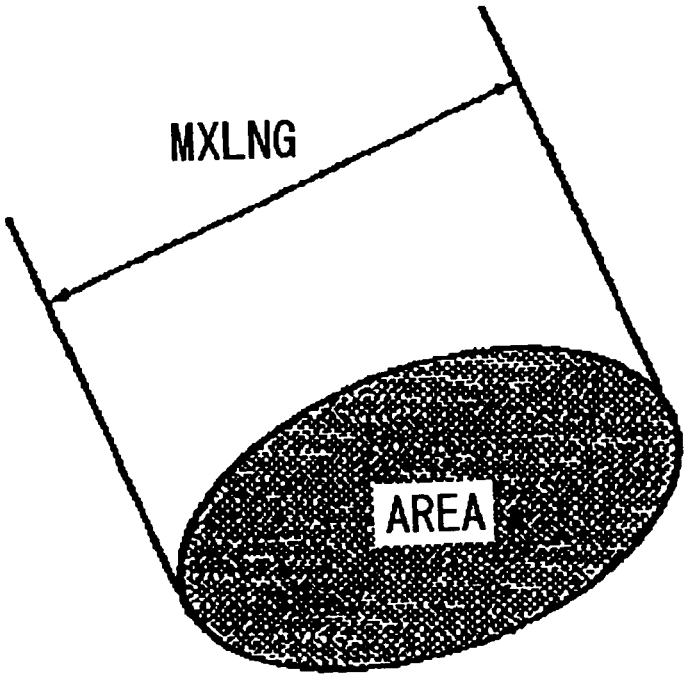
FIG. 9 is a view for describing a shape factor SF-1.

The shape of toner may be specified by either one of shape factors SF-1 and SF-2 also. As shown in FIG. 9, the shape factor SF-1 is a value representative of the degree of circularity of a spherical substance, i.e., a value produced by dividing the square of the maximum length MXLNG of an oval figure, which is the projection of a spherical substance in a bidimensional plane, by the area of the figure AREA and then multiplying the resulting quotient by 100π/4:

$$SF\text{-}1=\{(MXLNG)^2/\mathrm{AREA}\}\times(100\pi/4) \quad \text{Eq. (1)}$$

The shape of the spherical substance is a true circle when the shape factor SF-1 is 100 or becomes more amorphous as SF-1 becomes larger.

Figure 10:
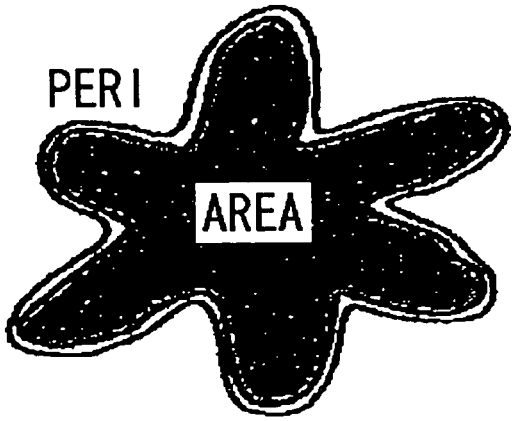
FIG. 10 is a view for describing a shape factor SF-2.

As shown in FIG. 10, the shape factor SF-2 is a value representative of the ratio of irregularity in the shape of a substance, i.e., a value produced by dividing the square of the peripheral length PERI of a figure, which is the projection of the substance in a bidimensional plane, by the area AREA of the figure and then multiplying the resulting quotient by 100/4π:

$$SF\text{-}2=\{(PERI)^2/\mathrm{AREA}\}\times(100/4\pi) \qquad \text{Eq. (2)}$$

The irregularity of the surface of a substance is zero when the shape factor SF-2 is 100 or increases with an increase in SF-2.

In the illustrative embodiment, 100 toner images were randomly sampled by use of FE-SEM (S-800) (trade name) available from HITACHI, LTD., and the resulting image information was introduced in an analyzer LUSEX3 (trade name) available from NIRECO CORPORATION.

Experiments showed that the more spherical the toner, i.e., the closer the shape factors SF-1 and SF-2 to 100, the lower the drive torque of the powder pump 70. More specifically, it was found that the drive torque decreased if the shape factor SF-1 was between 120 and 180 and if the shape factor SF-2 was between 120 and 190. This is presumably because the toner grains make only point-to-point contact with each other and with the periphery of the rotor and the walls of the spiral grooves of the stator, so that friction acting therebetween decreases.

Further, a decrease in the friction to act on the toner grains translates into an increase in the amount of toner replenishment for a unit time, allowing the size and the duration of drive of the powder pump 70 to be reduced and therefore saving power while enhancing durability. In addition, a decrease in the drive torque of the powder pump 70 and an increase in the amount of toner replenishment both serve to reduces stresses acting on the toner grains, thereby insuring high-quality images free from the defects mentioned earlier.

The grain size distribution of the toner is desirably narrow if use is made of dry toner having a volume-mean grain size Dv of 4 μm to 8 μm and a ratio Dv/Dn of the volume-mean grain size to a number-mean grain size Dn of 1.05 to 1.30. More specifically, the powder pump 70 sucks the toner from the toner container with vacuum and therefore sucks it more easily as the grain size becomes smaller, i.e., as the weight becomes smaller. Therefore, if the grain size is distributed over a broad range, then grains with small sizes are replenished before the other grains, resulting in noticeable variation in the grain size of the developer that would bring about background contamination and other image defects. With the grain size distribution stated above, it is possible to reduce such image defects even when the toner replenishing device uses the powder pump 70.

Figure 11:
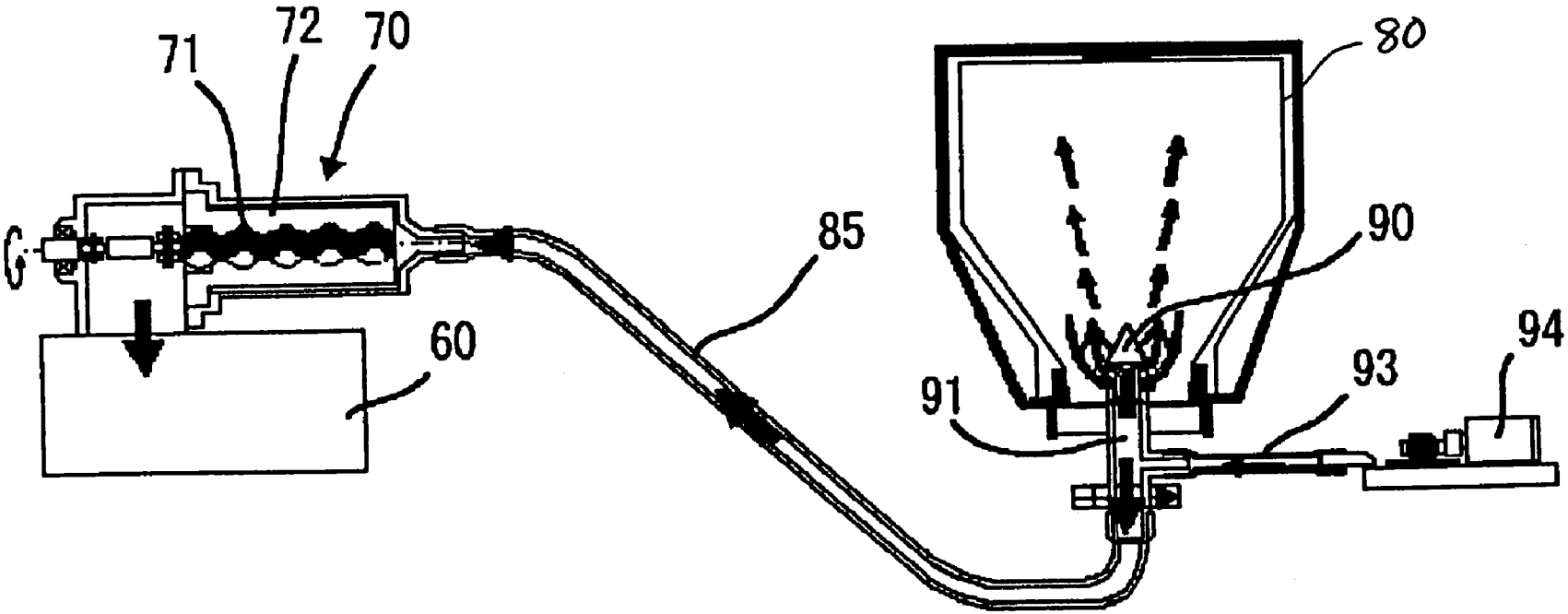
FIG. 11 shows another specific configuration of the toner replenishing device.

FIG. 11 shows a toner replenishing device that I used to experimentally determine a relation between the drive torque of the powder pump 70 and the kind of toner. As shown, in the toner replenishing device, the powder pump or screw pump means 70 is positioned in the vicinity of the developing device 60. The nozzle 90, having a circular cross-section, stands upright on the mount portion of the apparatus body and penetrates into the bag 80 when the bag 80 is mounted to the mount portion downward. One end of the tube 85 is connected to the lower end of the passage 91 formed in the nozzle 90. The tube 85 is bent rightward, as viewed in FIG. 11, at a level higher than the lower end of the passage 91 and connected to an air pump 94 by a tube 93.

When the air pump 94 is operated, it sends air under pressure into the toner container 80 via the tube 93. This air fluidizes the toner layer present in the toner container 80 while passing through the toner layer. Subsequently, the powder pump 70 is operated to suck the toner and air out of the toner container 80 for thereby replenishing the toner to the developing device 60.

Figure 12:
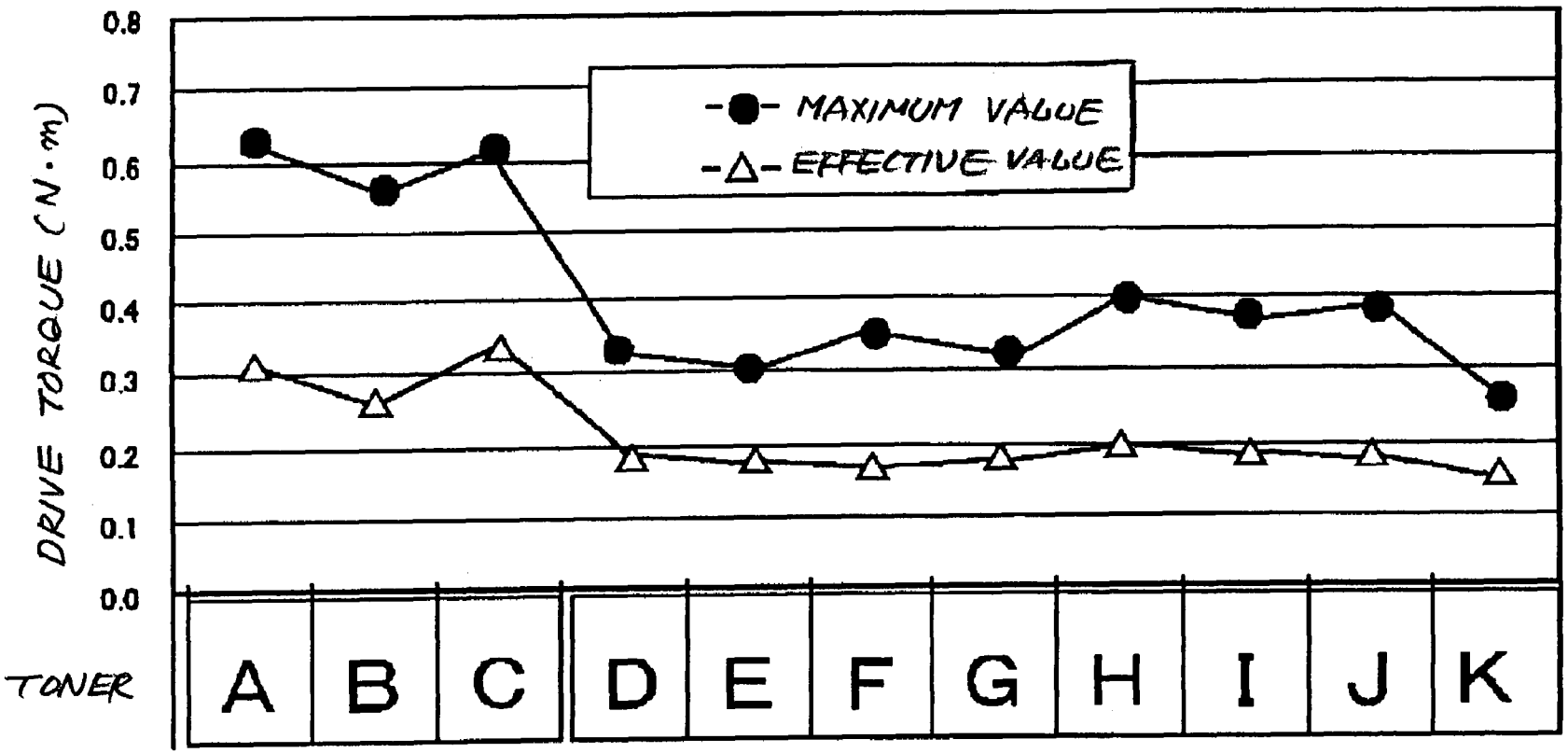
FIG. 12 is a graph showing a relation between the kind of toner and the drive torque determined with the toner replenishing device of FIG. 11.

As shown in FIG. 12, the above experiments also showed that the drive torque of the powder pump 70 was lower when the polymerized toners D through K were used than when the pulverized toners A through C were used.

It is to be noted that the illustrative embodiment is applicable not only to a toner replenishing device for replenishing toner from a toner container to a developing device, but also to a toner conveying device for conveying toner collected by a cleaning device to, e.g., a waste toner tank by use of screw pump means.

Various modifications will become possible for those skilled in the art after receiving the teachings of the present disclosure without departing from the scope thereof.

What is claimed is:

1. A toner conveying device for conveying a powdery toner, comprising:

a screw pump including an elastic stator formed with spiral grooves in an inside periphery thereof and a rotor rotatable inside said stator for conveying toner in an axial direction; and toner including a polymerized toner having a mean circularity of 0.95 to 0.99.

2. A toner conveying device for conveying a powdery toner, comprising:

a screw pump including an elastic stator formed with spiral grooves in an inside periphery thereof and a rotor rotatable inside said stator for conveying toner in an axial direction; and toner including a polymerized toner having a shape factor SF-1 of 120 to 180 and a shape factor SF-2 of 120 to 190, said shape factors SF-1 and SF-2 being respectively expressed as:

$$SF\text{-}1=\{(\mathrm{MXLNG})^2/\mathrm{AREA}\}\times(100\pi/4)$$

$$SF\text{-}2=\{(\mathrm{PERI})^2/\mathrm{AREA}\}\times(100/4\pi).$$

3. A toner conveying device for conveying a powdery toner, comprising:

a screw pump including an elastic stator formed with spiral grooves in an inside periphery thereof and a rotor rotatable inside said stator for conveying toner in an axial direction; and toner including a polymerized toner having a volume-mean grain size Dv and a number-mean grain size Dn, a ratio Dv/Dn of which is between 1.05 and 1.30.

4. A toner replenishing device, comprising:

a toner conveying device for conveying a powdery toner with a screw pump, which includes an elastic stator formed with spiral grooves in an inside periphery thereof and a rotor rotatable inside said stator for conveying toner in an axial direction, and configured to cause said toner conveying device to replenish a toner from a toner container to a developer for developing a latent image; and toner including a polymerized toner having a mean circularity of 0.95 to 0.99.

5. The device as claimed in claim 4, wherein said screw pump comprises a suction type of power pump.

6. The device as claimed in claim 4, further comprising:

an auxiliary toner storing section connected to said developer such that the toner is replenished from said toner container to said developer via said auxiliary toner storing section.

7. The device as claimed in claim 6, wherein a screw mechanism is disposed in said auxiliary toner storing section for feeding the toner to said developer.

8. A toner replenishing devices, comprising:

a toner conveying device for conveying a powdery toner with a screw pump, which includes an elastic stator formed with spiral grooves in an inside periphery thereof and a rotor rotatable inside said stator for conveying toner in an axial direction, and configured to cause said toner conveying device to replenish a toner from a toner container to a developer for developing a latent image; and toner including a polymerized toner having a shape factor SF-1 of 120 to 180 and a shape factor SF-2 of 120 to 190, said shape coefficients SF-1 and SF-2 being respectively expressed as:

$$SF\text{-}1=\{(MXLNG)^2/AREA\}\times(100\pi/4)$$

$$SF\text{-}2=\{(PERI)^2/AREA\}\times(100/4\pi).$$

9. The device as claimed in claim 8, wherein said screw pump comprises a suction type of power pump.

10. The device as claimed in claim 8, further comprising:

an auxiliary toner storing section connected to said developer such that the toner is replenished from said toner container to said developer via said auxiliary toner storing section.

11. The device as claimed in claim 10, wherein a screw mechanism is disposed in said auxiliary toner storing section for feeding the toner to said developer.

12. A toner replenishing devices, comprising:

a toner conveying device for conveying a powdery toner with a screw pump, which includes an elastic stator formed with spiral grooves in an inside periphery thereof and a rotor rotatable inside said stator for conveying toner in an axial direction, and configured to cause said toner conveying device to replenish a toner from a toner container to a developer for developing a latent image; and toner including a polymerized toner having a volume-mean grain size Dv and a number-mean grain size Dn, a ratio Dv/Dn of which is between 1.05 and 1.30.

13. The device as claimed in claim 12, wherein said screw pump comprises a suction type of power pump.

14. The device as claimed in claim 12, further comprising:

an auxiliary toner storing section connected to said developer such that the toner is replenished from said toner container to said developer via said auxiliary toner storing section.

15. The device as claimed in claim 14, wherein a screw mechanism is disposed in said auxiliary toner storing section for feeding the toner to said developer.

16. An image forming apparatus, comprising:

a toner replenishing device, said toner replenishing device includes a toner conveying device for conveying a powdery toner with a screw pump, which includes an elastic stator formed with spiral grooves in an inside periphery thereof and a rotor rotatable inside said stator for conveying toner in an axial direction, and causes said toner conveying device to replenish a toner from a toner container to a developer for developing a latent image; and toner including a polymerized toner having a mean circularity of 0.95 to 0.99.

17. The device as claimed in claim 16, wherein said screw pump comprises a suction type of power pump.

18. The device as claimed in claim 16, further comprising:

an auxiliary toner storing section connected to said developer such that the toner is replenished from said toner container to said developer via said auxiliary toner storing section.

19. The device as claimed in claim 18, wherein a screw mechanism is disposed in said auxiliary toner storing section for feeding the toner to said developer.

20. An image forming apparatus, comprising:

a toner replenishing device, said toner replenishing device includes a toner conveying device for conveying a powdery toner with a screw pump, which includes an elastic stator formed with spiral grooves in an inside periphery thereof and a rotor rotatable inside said stator for conveying toner in an axial direction, and causes said toner conveying device to replenish a toner from a toner container to a developer for developing a latent image; and toner including a polymerized toner having a shape factor SF-1 of 120 to 180 and a shape factor SF-2 of 120 to 190, said shape coefficients SF-1 and SF-2 being respectively expressed as:

$$SF\text{-}1=\{(MXLNG)^2/AREA\}\times(100\pi/4)$$

$$SF\text{-}2=\{(PERI)^2/AREA\}\times(100/4\pi).$$

21. The apparatus as claimed in claim 20, wherein said screw pump comprises a suction type of power pump.

22. The apparatus as claimed in claim 20, further comprising:

an auxiliary toner storing section connected to said developer such that the toner is replenished from said toner container to said developer via said auxiliary toner storing section.

23. The apparatus as claimed in claim 22, wherein a screw mechanism is disposed in said auxiliary toner storing section for feeding the toner to said developer.

24. An image forming apparatus, comprising:

a toner replenishing device, said toner replenishing device includes a toner conveying device for conveying a powdery toner with a screw pump, which includes an elastic stator formed with spiral grooves in an inside periphery thereof and a rotor rotatable inside said stator for conveying toner in an axial direction, and causes said toner conveying device to replenish a toner from a toner container to a developer for developing a latent image; and toner including a polymerized toner having a volume-mean grain size Dv and a number-mean grain size Dn a ratio Dv/Dn of which is between 1.05 and 1.30.

25. The apparatus as claimed in claim 24, wherein said screw pump comprises a suction type of power pump.

26. The apparatus as claimed in claim 24, further comprising:

an auxiliary toner storing section connected to said developer such that the toner is replenished from said toner container to said developer via said auxiliary toner storing section.

27. The apparatus as claimed in claim 26, wherein a screw mechanism is disposed in said auxiliary toner storing section for feeding the toner to said developer.

* * * * *